US011751644B2

(12) United States Patent
Maynard

(10) Patent No.: US 11,751,644 B2
(45) Date of Patent: Sep. 12, 2023

(54) MEDICAL ALERT NECKLACE

(71) Applicant: Kristofer M. Maynard, Spokane, WA (US)

(72) Inventor: Kristofer M. Maynard, Spokane, WA (US)

( * ) Notice: Subject to any disclaimer, the term of this patent is extended or adjusted under 35 U.S.C. 154(b) by 166 days.

(21) Appl. No.: 17/328,671

(22) Filed: May 24, 2021

(65) Prior Publication Data

US 2021/0274892 A1 Sep. 9, 2021

Related U.S. Application Data

(60) Continuation-in-part of application No. 16/232,864, filed on Dec. 26, 2018, now abandoned, which is a division of application No. 15/085,836, filed on Mar. 30, 2016, now abandoned.

(60) Provisional application No. 62/143,933, filed on Apr. 7, 2015.

(51) Int. Cl.
*A44C 5/00* (2006.01)
*A44C 15/00* (2006.01)

(52) U.S. Cl.
CPC ..... *A44C 5/003* (2013.01); *A44C 15/002* (2013.01); *A44C 15/005* (2013.01)

(58) Field of Classification Search
CPC ..... A61J 1/03; A44C 5/003; A44C 15/002; A44C 15/005; A44C 5/185; A44C 15/0015; A44C 25/001
USPC ..... 63/1.11, 1.14, 3; 222/175; 224/148, 224/148.7, 219, 221; 206/37, 496, 828
See application file for complete search history.

(56) References Cited

U.S. PATENT DOCUMENTS

| | | | | |
|---|---|---|---|---|
| 3,567,085 | A | 3/1971 | Flores | |
| 4,078,660 | A | 3/1978 | Lerro | |
| 4,265,381 | A | 5/1981 | Muscatell | |
| 5,782,107 | A | 7/1998 | Glanz | |
| 6,155,409 | A * | 12/2000 | Hettinger | G09F 21/02 63/19 |
| 6,223,559 | B1 * | 5/2001 | Coleman | A44C 15/0015 40/457 |
| D562,717 | S | 2/2008 | Gonzalez | |

(Continued)

OTHER PUBLICATIONS

"Final Office Action", U.S. Appl. No. 16/232,864, dated Dec. 3, 2020, 8 pages.

(Continued)

*Primary Examiner* — Jack W Lavinder
(74) *Attorney, Agent, or Firm* — FIG. 1 Patents

(57) ABSTRACT

A medical alert necklace is formed with a container loop wearable around a neck of a user and contains a medical dose as an ingestible for the user. The medical alert necklace includes a personalized pendant that uniquely identifies the user as having a medical condition, and includes a quick response (QR) code accessible to identify an emergency contact person for the user and/or medical information about the user. The medical alert necklace can also include an alert system that receives an alert activation from a smartphone and activates to warn of a hypoglycemic condition of the user. The medical alert necklace has a fastening system to secure the container loop around the user, such as a magnetic clasp. The fastening system includes a plunger press-fit into the container loop. The ingestible is distributable for user consumption through the plunger, and the container loop is refillable through the plunger.

19 Claims, 7 Drawing Sheets

(56) References Cited

U.S. PATENT DOCUMENTS

| | | | | |
|---|---|---|---|---|
| 9,463,914 | B2 | 10/2016 | Andochick | |
| 11,607,020 | B2 * | 3/2023 | Dailey | G06F 1/163 |
| 2011/0094265 | A1 | 4/2011 | Dost et al. | |
| 2011/0127293 | A1 * | 6/2011 | Pascatore | B65D 37/00 222/386 |
| 2016/0295976 | A1 | 10/2016 | Maynard | |
| 2019/0159557 | A1 | 5/2019 | Maynard | |

OTHER PUBLICATIONS

"Non-Final Office Action", U.S. Appl. No. 15/085,836, dated Jul. 11, 2018, 6 pages.
"Non-Final Office Action", U.S. Appl. No. 16/232,864, dated Jun. 17, 2020, 8 pages.
"Restriction Requirement", U.S. Appl. No. 15/085,836, dated Mar. 8, 2018, 6 pages.
"Restriction Requirement", U.S. Appl. No. 16/232,864, dated May 7, 2020, 6 pages.

* cited by examiner

MEDICAL ALERT NECKLACE

RELATED APPLICATIONS

This application is a continuation-in-part of, and claims priority to, U.S. patent application Ser. No. 16/232,864 filed Dec. 26, 2018 entitled "Containers Formed as Apparel," the disclosure of which is incorporated by reference herein in its entirety. The U.S. patent application Ser. No. 16/232,864 is a divisional of, and claims priority to, U.S. patent application Ser. No. 15/085,836 filed Mar. 30, 2016 entitled "Medical Condition Recovery Apparel," the disclosure of which is incorporated by reference herein in its entirety. The U.S. patent application Ser. No. 15/085,836 claims priority to U.S. Provisional Patent Application Ser. No. 62/143,933 filed Apr. 7, 2015 entitled "Medical Jewelry Device," the disclosure of which is incorporated by reference herein in its entirety.

BACKGROUND

Blood sugar is also known as glucose, and without enough glucose, the human body cannot perform its normal functions. If the glucose level in one's body reaches an extreme low, a hypoglycemic episode may occur and immediate treatment is needed. A hypoglycemic episode, also referred to as an insulin reaction, is a diabetic condition that can occur when one's blood glucose is lower than normal. This is a common effect of diabetes, which afflicts millions of people, and such reactions can become part of a diabetic's life. Low blood sugar can occur in diabetics who take medicines that decrease insulin levels, and taking too much medication, skipping meals, eating less than normal, or exercising more than usual can lead to low blood sugar.

A hypoglycemic episode can be treated by the diabetic person consuming a carbohydrate-rich food, such as a glucose tablet or juice. Conventional medical alert necklaces and bracelets are good for alerting personnel and medical first responders of a medical condition, but generally, products are not available for the immediate treatment of a person having a diabetic crisis. Once a diabetic person becomes unresponsive, friends and family may not have any treatment at hand to help the person, and seldom have glucose that can be easily located and administered to counter the hypoglycemic episode. Medical first responders are usually equipped with glucose gel that can be administered by rubbing it between the tongue and gums of an unconscious person. However, waiting for a medical response takes time and the longer a person is in a hypoglycemic state, the more devastating the crisis can become.

Diabetics may choose to restrict their physical activities or limit their career choices for fear of such low blood sugar episodes. Athletes such as runners, football and basketball players, and those in physical careers, such as firefighters, police officers, construction workers, trainers, and even drivers are just a few occupations that can be restrictive to a person living with diabetes. Even diabetic students can be disadvantaged during academic tests because when their blood sugar drops, they are not at full mental capacity. With some of the physical activities and career choices, a person can carry glucose to have available when one's blood sugar levels drop, however diabetic athletes generally have a difficult time carrying glucose, particularly when wearing only athletic apparel.

SUMMARY

This Summary introduces features and concepts of a medical alert necklace, which is further described below in the Detailed Description and/or shown in the Figures. This Summary should not be considered to describe essential features of the claimed subject matter, nor used to determine or limit the scope of the claimed subject matter.

A medical alert necklace is described. In embodiments, a medical alert necklace is formed with a container loop, which is wearable around the neck of a user and contains a medical dose as an ingestible for the user. For example, the medical dose can be a glucose dose that is contained as the ingestible and is accessible to the user. The medical alert necklace can include a personalized pendant that uniquely identifies the user as having a medical condition, such as a diabetic condition. Additionally, the personalized pendant of the medical alert necklace can include a quick response (QR) code, which is accessible by anyone with a smartphone to identify an emergency contact person for the user and/or medical information about the user. The medical alert necklace can also include an alert system that receives an alert activation from a smartphone and activates to warn of a hypoglycemic condition of the user. For example, the medical alert necklace may be implemented with an audible and/or visual alert system to warn of a medical condition of the user.

The medical alert necklace also has a fastening system to secure the container loop as worn around the neck of the user, such as with a magnetic clasp or other type of quick release. The fastening system includes a plunger press-fit into the container loop, where the ingestible is distributable for consumption by the user through the plunger. The fastening system also includes a plunger cap secured to the plunger, and the plunger cap seals the ingestible in the container loop. The container loop is also refillable through the plunger. For example, the plunger cap is replaceable by a fill cap, which allows affixing a replenish device that refills the container loop with the ingestible.

In implementations, the magnetic clasp or other quick release that secures the medical alert necklace as worn by the user has a first tensional resistance that resists pulling forces separating the magnetic clasp. Further, the plunger cap that is secured to the plunger has a second tensional resistance that resists the pulling forces separating the plunger cap from the plunger. The first tensional resistance of the magnetic clasp is less than the second tensional resistance of the plunger cap, effective to separate the magnetic clasp before the plunger cap is separated from the plunger responsive to the pulling forces. Notably, when a user seeks to access the ingestible contained in the medical alert necklace and grabs to pull the necklace off, the magnetic clasp will release first so that the user has access to an end of the container loop, and the user can then pull the plunger cap off to access the ingestible.

BRIEF DESCRIPTION OF THE DRAWINGS

Embodiments of a medical alert necklace are described with reference to the following Figures. The same numbers may be used throughout to reference like features and components that are shown in the Figures.

DETAILED DESCRIPTION

Figure 1:
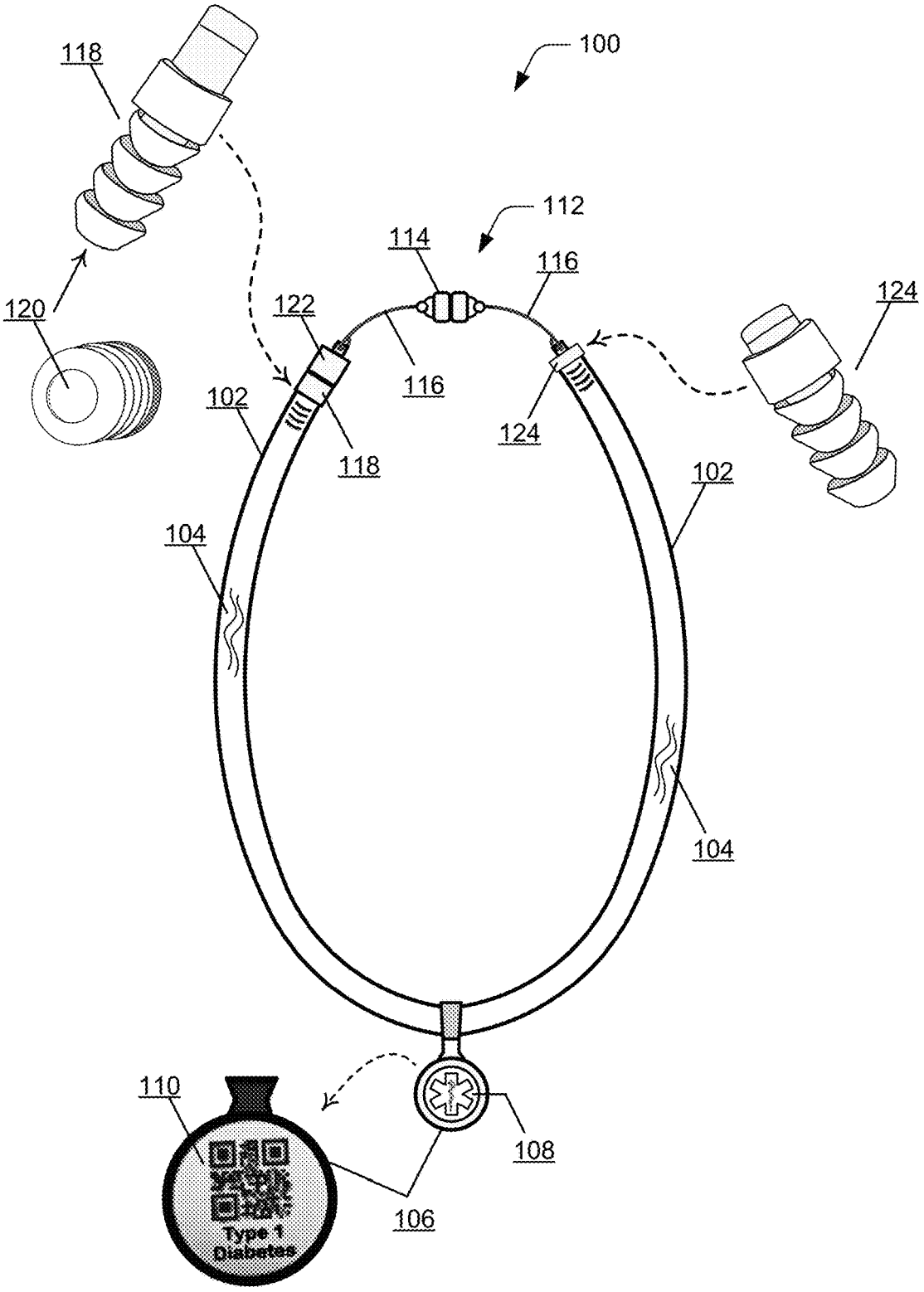
FIG. 1 illustrates an example of a medical alert necklace in accordance with one or more embodiments described herein.

Embodiments of a medical alert necklace are described, and can be implemented to provide a user with an apparel item that contains a medical treatment, such as a glucose dose for medical recovery from a diabetic condition that may cause a hypoglycemic episode. In embodiments, the medical alert necklace is an apparel item that stores one or more measured or metered doses of glucose, and serves to identify that a person wearing the medical alert necklace is a diabetic. In other implementations, the medical alert necklace described herein may be worn as a bracelet or anklet, or as any other type of apparel item. The medical alert necklace provides any type of medical, drug related, or non-drug related product or solution, such as for the life threatening problems that every diabetic may face without much warning. A medical alert necklace that contains a glucose dose as a medical treatment will provide a diabetic person with quick access to necessary glucose, in any environment, and the glucose dose is accessible to the person while the medical alert necklace remains positioned about the neck of the person. The medical alert necklace also serves as a medical and/or diabetic alert for anyone assisting an individual who may not be able to help themselves.

In implementations, a medical alert necklace is formed with a container loop, which is wearable around the neck of a user and contains a medical dose as an ingestible for the user. For example, the medical dose can be a glucose dose that is contained as the ingestible and is accessible to the user. The medical alert necklace can include a personalized pendant that uniquely identifies the user as having a medical condition, such as a diabetic condition. Additionally, the personalized pendant of the medical alert necklace can include a quick response (QR) code, which is accessible by anyone with a smartphone to identify an emergency contact person for the user and/or medical information about the user. The QR code is unique for each individual person who wears a medical alert necklace. Further, the QR code is scannable with any smartphone to pull up the emergency contact for the person, the medical information about the person, and/or any other types of emergency medical information associated with the person.

The medical alert necklace can also include an alert system that receives an alert activation from a smartphone and activates to warn of a hypoglycemic condition of the user. For example, the medical alert necklace can be implemented with an audible and/or visual alert system to warn of a medical condition of the user. In an implementation, the personalized pendant includes an audible alert system that can receive an alert activation from a smartphone and activate a speaker of audible alert system effective to warn of a hypoglycemic condition of the user. The user and/or another person in the vicinity of the user will be alerted of the medical condition of the user.

The smartphone can be paired to receive data as blood sugar readings from a continuous glucose monitoring (CGM) sensor and transmitter device worn by the user to monitor his or her blood sugar readings. Similarly, the smartphone can also be paired with the personalized pendant of the medical alert necklace, which receives the alert activation from the smartphone. Alternatively or in addition to the audible alert system, the medical alert necklace can also include a visual alert system that receives the alert activation from the smartphone and activates the visual alert system effective to warn of a hypoglycemic condition of the user. For example, the container loop of the of the medical alert necklace that contains the medical dose as the ingestible for the user can be implemented to light up and/or flash so that the user and/or another person in the vicinity of the user will be alerted of the medical condition of the user.

The medical alert necklace also has a fastening system to secure the container loop as worn around the neck of the user, such as with a magnetic clasp or other type of quick release. The fastening system includes a plunger press-fit into the container loop, where the ingestible is distributable for consumption by the user through the plunger. The fastening system also includes a plunger cap secured to the plunger, and the plunger cap seals the ingestible in the container loop. The container loop is also refillable through the plunger. For example, the plunger cap is replaceable by a fill cap, which allows affixing a replenish device that refills the container loop with the ingestible. Alternatively, the replenish device may have an integrated fill cap that mates with the plunger, facilitating a refill of the container loop with the ingestible by the replenish device.

In implementations, the magnetic clasp or other quick release that secures the medical alert necklace as worn by the user has a first tensional resistance that resists pulling forces separating the magnetic clasp. Further, the plunger cap that is secured to the plunger has a second tensional resistance that resists the pulling forces separating the plunger cap from the plunger. The first tensional resistance of the magnetic clasp is less than the second tensional resistance of the plunger cap, effective to separate the magnetic clasp before the plunger cap is separated from the plunger responsive to the pulling forces. Notably, when a user seeks to access the ingestible contained in the medical alert necklace and grabs to pull the necklace off, the magnetic clasp will release first so that the user has access to an end of the container loop, and the user can then pull the plunger cap off to access the ingestible, which is distributable from the container loop through the plunger.

While features and concepts of a medical alert necklace can be implemented in any number of different items, environments, and/or configurations, embodiments of a medical alert necklace are described in the context of the following example apparel items and methods.

FIG. 1 illustrates an example of a medical alert necklace 100 as shown and described in one or more implementations. In this example, the medical alert necklace 100 can be secured and worn around the neck of a user, such as an apparel item. The medical alert necklace 100 is formed with a container loop 102, which is a loop structure designed to encompass an appendage when worn by a user, and contains a medical dose as an ingestible 104 for the user. For example, the medical dose can be a glucose dose that is contained as the ingestible 104 and is accessible to the user. In embodiments, the medical alert necklace 100 can be used to keep one or more doses of glucose readily at hand, and serves to identify that a person wearing the medical alert necklace is a diabetic. In other implementations, the medical alert necklace 100 described herein may be worn as a bracelet or anklet, or as any other type of apparel item. Additionally, the structure of the container loop 102 may incorporate any type of tubing, wire, band, chain, or other type of jewelry or apparel structure.

A medical alert necklace 100 that contains a glucose dose as a medical treatment can provide a diabetic person with quick access to necessary glucose, in any environment, and the medical alert necklace serves as a medical and/or diabetic alert for anyone assisting an individual who may not be able to help themselves. The medical alert necklace 100 can be worn by a person at all times and provides a dose of glucose gel, which can be administered by the person themselves, or by another person, without having to search for the glucose gel and without having to wait for responding medical services. This can help to eliminate the potential of serious complications or possible death of the diabetic person when the glucose gel in the medical alert necklace 100 can be directly administered to the mouth of the diabetic person by simply squeezing a part of the necklace that contains the glucose gel.

In this example, the medical alert necklace 100 includes a personalized pendant 106 that uniquely identifies the user (e.g., the wearer of the medical alert necklace) as having a medical condition, such as a diabetic condition. The personalized pendant 106 can include any type of insignia 108 to identify the person as having a medical condition. Additionally, the personalized pendant 106 of the medical alert necklace 100 can include a quick response (QR) code 110, which is unique to the user and is accessible by anyone with a smartphone to identify an emergency contact person for the user and/or medical information about the user. As shown in the example, the personalized pendant 106 may generally include the insignia 108 to identify the person as having a medical condition on one side of the personalized pendant, and can include the QR code 110 on the other side of the personalized pendant. As shown, the medical condition insignia 108 may be viewable on the front of the personalized pendant 106 as the user wears the medical alert necklace 100, and the QR code 110 is generally out of view on the back of the personalized pendant as the user wears the medical alert necklace, or vice-versa.

The medical alert necklace 100 has a fastening system 112 to secure the container loop 102 as worn around the neck of the user, such as with a magnetic clasp 114 or other type of quick release. The magnetic clasp 114 is a fastener designed to pull apart and separate the ends of the container loop 102 for quick removal from the user. Generally, the magnetic clasp 114 may be easier for a person having a hypoglycemic episode to remove by simply pulling apart anywhere near the ends of the medical alert necklace 100, thus releasing the fastening apparatus. Although generally shown and described herein as a magnetic clasp 114, the fastening apparatus may be implemented as one of many other types of fasteners commonly used for jewelry and apparel. Further, the fastening system 112 may include any type of an adjustable section 116, such as a chain, cord, and/or hooks so that the medical alert necklace 100 can be adjusted for length to fit any person (e.g., large, small, adult, child, etc.).

The fastening system 112 includes a plunger 118 that is press-fit into an end of the container loop 102. The plunger 118 includes a void 120 through which the ingestible 104 is distributable from the container loop 102 for consumption by the user through the plunger. The fastening system 112 also includes a plunger cap 122 that secures to the plunger 118, and the plunger cap seals the ingestible 104 in the container loop. Generally, a user who wears the medical alert necklace 100 can gain access to the ingestible 104 in the container loop 102 of the medical alert necklace 100 by first pulling apart the magnetic clasp 114 and then pulling the plunger cap 122 off of the plunger 118. The fastening system 112 also includes a similar-type plunger 124 that is press-fit into the other end of the container loop 102, and the plunger 124 seals the ingestible 104 in the container loop without a void through the plunger. Alternatively, both ends of the container loop 102 may be implemented with the type of plunger 118 that includes the void 120 through which the ingestible 104 is distributable from either end of the container loop 102 for consumption by the user.

In implementations, the magnetic clasp 114 or other quick release that secures the medical alert necklace 100 as worn by the user has a first tensional resistance that resists pulling forces separating the magnetic clasp. Further, the plunger cap 122 that is secured to the plunger 118 has a second tensional resistance that resists the pulling forces separating the plunger cap from the plunger. The first tensional resistance of the magnetic clasp 114 is less than the second tensional resistance of the plunger cap 122, effective to separate the magnetic clasp before the plunger cap is separated from the plunger responsive to the pulling forces. Notably, when a user seeks to access the ingestible 104 contained in the medical alert necklace 100 and grabs to pull the necklace off, the magnetic clasp 114 will release first so that the user has access to an end of the container loop 102, and the user can then pull the plunger cap 122 off to access the ingestible, which is distributable from the container loop through the void 120 in the plunger.

Figure 2:
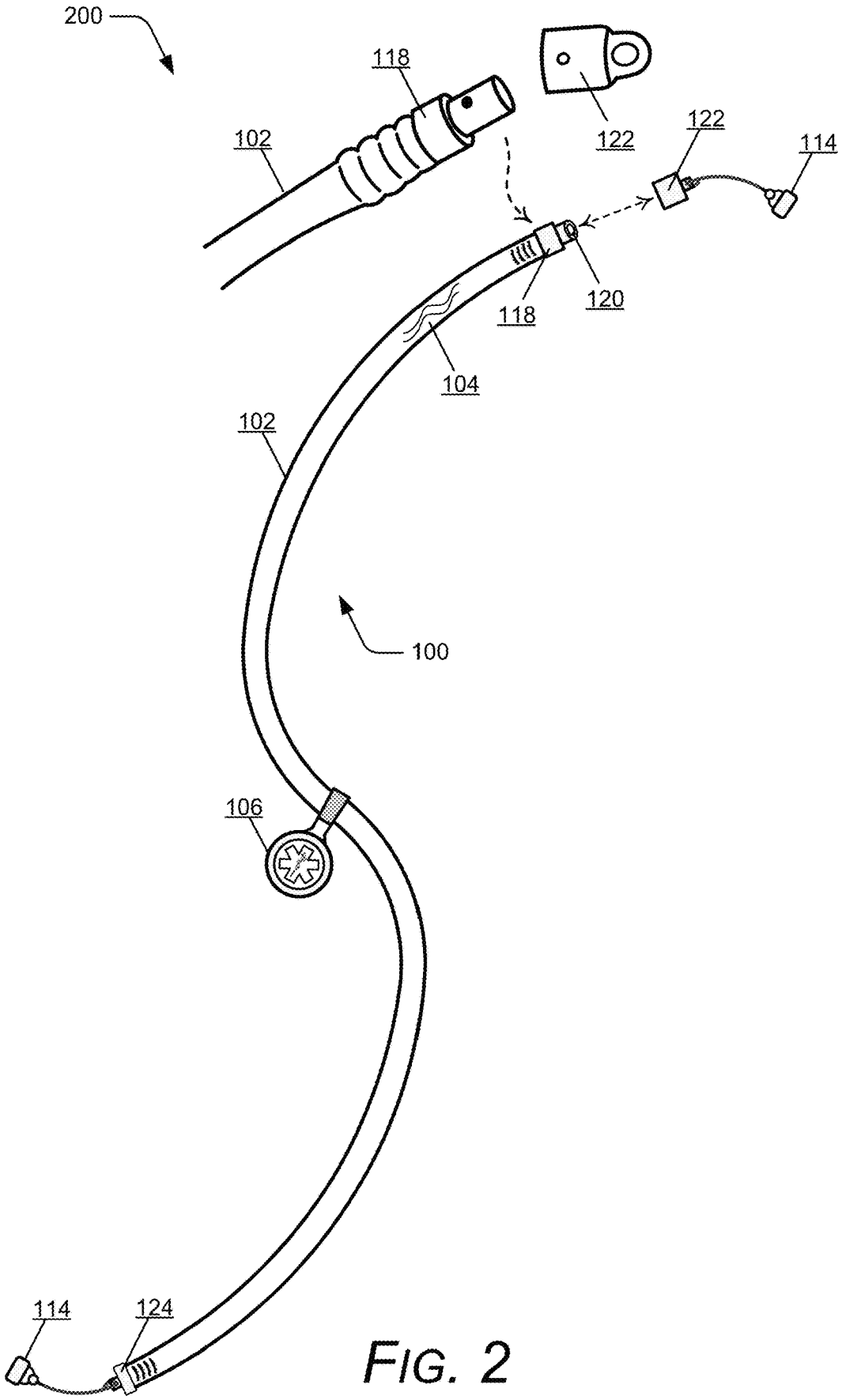
FIG. 2 further illustrates an example of the medical alert necklace in accordance with one or more embodiments described herein.

FIG. 2 further illustrates an example 200 of the medical alert necklace 100 with the magnetic clasp 114 having been disconnected, such as when a user has pulled apart the medical alert necklace, thus releasing the fastening apparatus. In this example 200, the container loop 102 of the medical alert necklace 100 is shown as a flexible, hollow tubing that may be transparent, semi-transparent, or solid-colored and having the void space in which the medical dose or treatment is contained as the ingestible 104 for the user. In implementations, the container loop may be constructed with a soft durometer polypropylene that is flexible and comfortable for a person to wear as a necklace, bracelet, anklet, and the like. Alternatively, the container loop 102 may be constructed with a harder or more durable tubing or other structure in the interest of minimizing damage, maintaining the integrity of the loop structure, for waterproofing, and/or for any other design and wear consideration.

As described above, the medical dose can be a glucose dose that is contained as the ingestible 104 and is accessible to the user for treating a diabetic condition, such as if the user is a diabetic and susceptible to having a hypoglycemic episode. In implementations, the void space of the container loop 102 contains the glucose dose that is accessible to the user. The medical alert necklace 100 may also be used for many other types of medical treatments in the form of powders, liquids, gels, lotions, tablets, beads, and the like, to include both ingestible (internal medical treatments) and applications (external medical treatments).

It should be noted that the medical treatment may be for less emergent conditions that are not often thought of as a "medical emergency". For example, the medical treatment may not be an ingestible, but rather suntan lotion that anyone, and in particular someone with a skin sensitivity to direct sunlight, may want to have readily available in the medical alert necklace. Further, the medical treatment may be an energy boost in any solid, gel, or liquid form as the ingestible 104, such as to counteract feelings of dizziness, dehydration, and any other types of conditions that may not be medically-emergent, yet could lead to a medical episode. In specific implementations for particular types of medical treatments in proper doses, the length of the container loop 102 and/or the diameter of the void space in the loop structure can be adjusted accordingly to accommodate a dose of the medical treatment, or for multiple doses of the medical treatment.

As described above, a user who wears the medical alert necklace 100 can gain access to the ingestible 104 in the container loop 102 of the medical alert necklace 100 by first pulling apart the magnetic clasp 114 and then pulling the plunger cap 122 off of the plunger 118. In implementations, the magnetic clasp 114 or other quick release that secures the medical alert necklace 100 as worn by the user has a first tensional resistance that resists pulling forces separating the magnetic clasp. Further, the plunger cap 122 that is secured to the plunger 118 has a second tensional resistance that resists the pulling forces separating the plunger cap from the plunger. The first tensional resistance of the magnetic clasp 114 is less than the second tensional resistance of the plunger cap 122, effective to separate the magnetic clasp before the plunger cap is separated from the plunger responsive to the pulling forces. Notably, when a user seeks to access the ingestible 104 contained in the medical alert necklace 100 and grabs to pull the necklace off, the magnetic clasp 114 will release first so that the user has access to an end of the container loop 102, and the user can then pull the plunger cap 122 off to access the ingestible, which is distributable from the container loop through the void 120 in the plunger.

Figure 3:
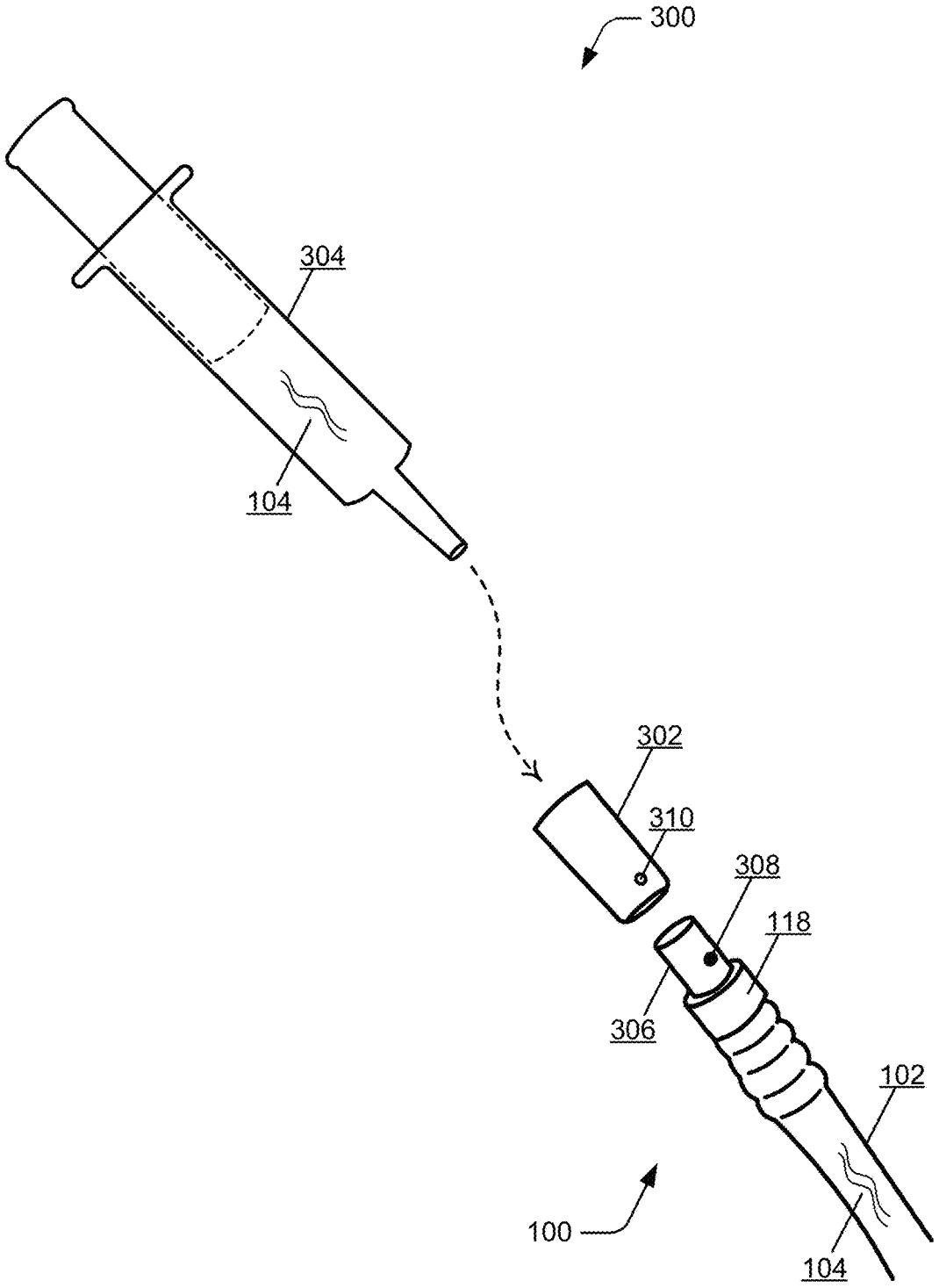
FIG. 3 further illustrates the example of the medical alert necklace in accordance with one or more embodiments described herein.

FIG. 3 further illustrates an example 300 of the medical alert necklace 100 as shown and described in one or more implementations. As described above, the fastening system 112 of the medical alert necklace 100 includes the plunger 118 that is press-fit into an end of the container loop 102. The plunger 118 includes the void 120 through which the ingestible 104 is distributable from the container loop 102 for consumption by the user through the plunger. The fastening system also includes the plunger cap 122 that secures to the plunger 118, and the plunger cap seals the ingestible 104 in the container loop.

In implementations, the container loop 102 is also refillable with the ingestible 104 through the void 120 in the plunger 118. For example, the plunger cap 122 is replaceable by a fill cap 302, which allows affixing a replenish device 304 that can be utilized to refill the container loop 102 with the ingestible. As shown in this example, the plunger 118 has an extended portion 306 onto which the plunger cap 122 and/or the fill cap 302 are attached. Additionally, the extended portion 306 of the plunger 118 has a protruding knob 308 designed to engage with a void or recess 310 in the plunger cap 122 and/or in the fill cap 302, which secures the plunger cap 122 and/or the fill cap 302 onto the extended portion 306 of the plunger. In other implementations, the replenish device 304 may have an integrated fill cap that mates with the extended portion 306 of the plunger 118, facilitating a refill of the container loop 102 with the ingestible 104 by the replenish device.

Figure 4:
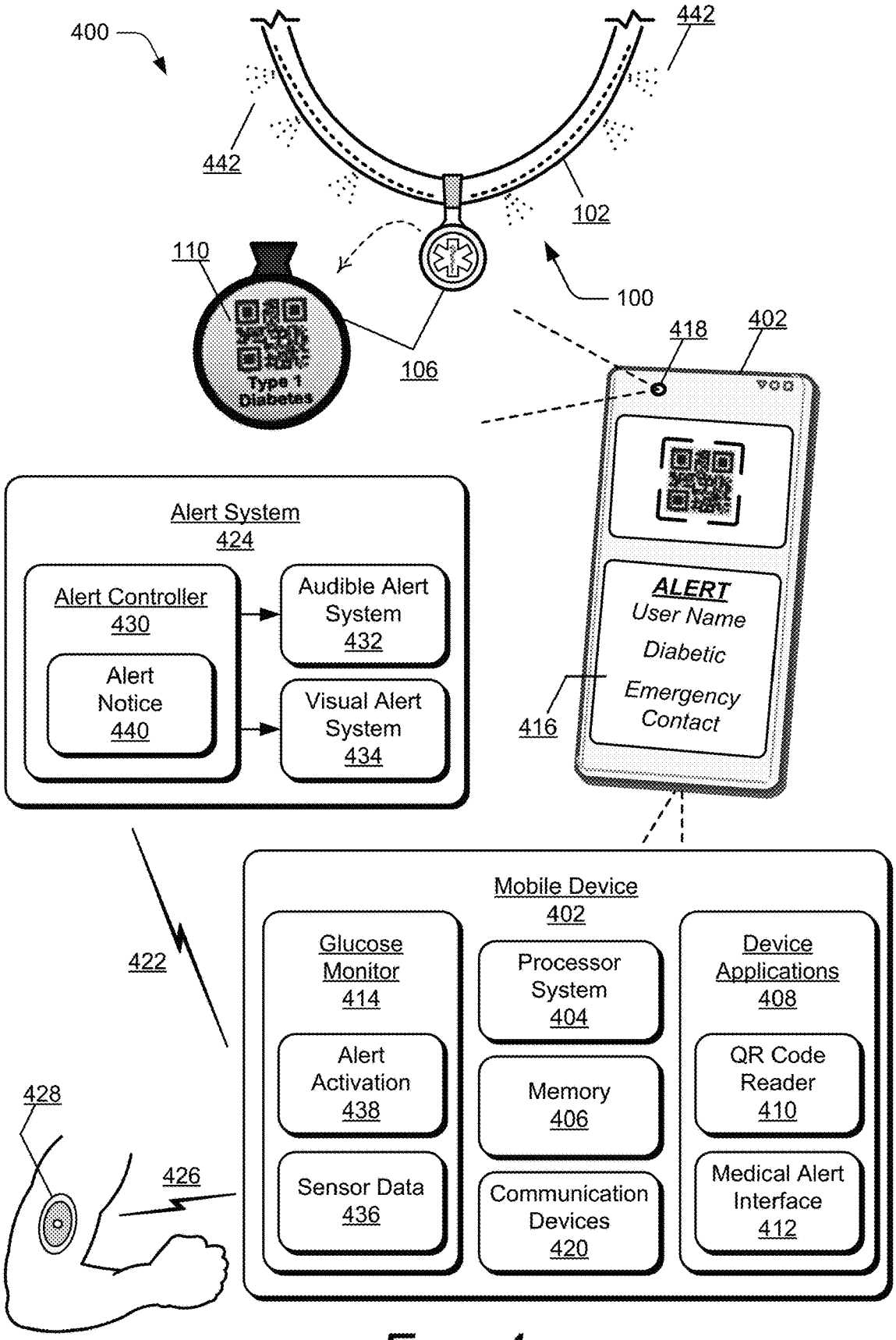
FIG. 4 further illustrates an example of a medical alert necklace in accordance with one or more embodiments described herein.

FIG. 4 illustrates an example 400 of techniques implemented with the medical alert necklace 100 and a mobile device 402. In this example 400, the mobile device 402 may be a wireless device, such as any type of smartphone, mobile phone, or tablet device. Generally, the mobile device 402 may be any type of an electronic, computing, and/or communication device, such as a computer, a laptop, a tablet, a wireless device, and so forth. The mobile device 402 can be implemented with various components, such as a processor system 404 and memory 406, as well as any number and combination of different components as further described with reference to the example device shown in FIG. 8. For example, the mobile device 402 can include a power source to power the device, such as a rechargeable battery and/or any other type of active or passive power source that may be implemented in an electronic, computing, and/or communication device.

The mobile device 402 includes device applications 408, such as a QR code reader 410, a medical alert interface 412, a glucose monitor 414, and/or any other of the many possible types of device applications. Many device applications have an associated application user interface 416 that is generated and displayed for user interaction and/or viewing, such as on a display screen of the mobile device 402. Generally, an application user interface 416, or any other type of video, image, graphic, and the like is digital image content that is displayable on the display screen of the mobile device. In implementations, the QR code 110 included on the personalized pendant 106 can be imaged, such as with a camera device 418 of the mobile device 402, and the QR code reader 410 can then read and process the QR code. The user interface 416 can then display the name of the user, an emergency contact person for the user, and/or medical information about the user.

As software applications or modules, the QR code reader 410, the medical alert interface 412, and the glucose monitor 414 can be executed by the processor system 404 of the mobile device 402, and can be stored on computer-readable storage memory (e.g., the memory 406 of the device), or in any other suitable memory device or electronic data storage implemented with the mobile device. Alternatively or in addition, any of the applications may be implemented as modules in firmware and/or at least partially in computer hardware. For example, at least part of the modules may be executable by a computer processor, and/or at least part of the modules may be implemented in logic circuitry.

The mobile device 402 also includes communication devices 420, such as communication transceivers for Bluetooth™, Bluetooth Low Energy (BLE), WiFi™ and/or any other network communications. In implementations, the mobile device 402 may be communicatively linked, such as by a wireless connection 422 that pairs the mobile device with an alert system 424 of the personalized pendant 106 for wireless data communication, as managed by the medical alert interface 412 at the mobile device. Similarly, the mobile device 402 may be communicatively linked, such as by a wireless connection 426 that pairs the mobile device with a glucose monitoring sensor 428 worn by the user who also wears the medical alert necklace 100. Generally, the user wears the glucose monitoring sensor 428 to monitor his or her blood sugar readings.

In this example 400, the personalized pendant 106 of the medical alert necklace 100 implements the alert system 424, which includes an alert controller 430 that can activate an audible alert system 432 and/or a visual alert system 434 of the medical alert necklace. The alert controller 430 is a module which may include independent processing, memory, and/or logic components functioning as a computing and/or electronic device integrated with the personalized pendant 106. Alternatively or in addition, the alert controller 430 can be implemented in software (e.g., as computer-executable instructions), in hardware, or as a combination of software and hardware components to implement the techniques and features of the medical alert necklace 100, as described herein.

As a software application or module, the alert controller 430 can be stored on computer-readable storage memory (e.g., in memory of the device). Alternatively or in addition, the alert controller 430 may be implemented in firmware and/or at least partially in computer hardware. For example, at least part of the module may be executable by a computer processor, and/or at least part of the module may be implemented in logic circuitry. Additionally, the personalized pendant 106 of the medical alert necklace 100 can be implemented with any number and combination of different components as further described with reference to the example device shown in FIG. 8. In implementations, the alert system 424 of the personalized pendant 106 is configurable via the medical alert interface 412 implemented in the mobile device 402.

In aspects of the described techniques, the mobile device 402 (e.g., a smartphone) can be paired for data communication with the glucose monitoring sensor 428 worn by the user who also wears the medical alert necklace 100. The mobile device 402 can receive sensor data 436 as blood sugar readings from the glucose monitoring sensor 428 worn by the user to monitor his or her blood sugar readings. The glucose monitor 414 implemented by the mobile device 402 monitors and evaluates the sensor data 436 received from the glucose monitoring sensor 428. When the glucose monitor 414 detects, or begins to detect, a drop in the user's blood sugar, the glucose monitoring application can generate and initiate to communicate an alert activation 438 to the personalized pendant 106.

The personalized pendant 106 of the medical alert necklace 100 can receive the alert activation 438 communicated from the mobile device 402. The alert controller 430 of the alert system 424 implemented by the personalized pendant 106 can then initiate an alert notice 440 based on the received alert activation. The alert controller 430 initiates the alert notice 440 to activate either one or both of the audible alert system 432 and the visual alert system 434 to warn of a pending or current hypoglycemic condition of the user. In an implementation, the audible alert system 432 of the personalized pendant 106 is activated as a sound-emitting speaker effective to warn of a hypoglycemic condition of the user. In a similar implementation, the alert controller 430 activates the visual alert system 434, which can include LED or similar lighting of the container loop 102 emitting a flashing, pulsing, or constant light 442 effective to warn of the pending or current hypoglycemic condition of the user. The user and/or another person in the vicinity of the user will be alerted of the medical condition of the user based on one or both of the audible and flashing alerts.

In an event the user does not respond to the alerts that have been activated by the personalized pendant 106 of the medical alert necklace 100, the alert controller 430 of the alert system 424 can initiate to communicate an emergency alert back to the mobile device 402. For example, the alert controller 430 can determine that the user has not responded to the alerts based on updated sensor data 436 received from the mobile device 402, as processed by the glucose monitor 414 of the mobile device. In implementations, the emergency alert may be communicated from the personalized pendant 106 back to the mobile device 402 after a designated time duration, such as after a designated number of minutes (e.g., three minutes, five minutes, etc.). For example, the alert controller 430 of the alert system 424 may initiate to communicate an emergency alert back to the mobile device 402 after a determination that the user, or a person helping the user, has not responded to the initial audible and/or visual alerts. The medical alert interface 412 implemented in the mobile device 402 can receive the emergency alert and initiate an emergency 911 auto-call from the mobile device (e.g., from the user's smartphone) to summon help for the user.

In other implementations, the alert controller 430 can determine that the user has not responded to the alerts based on sensor data indicating whether the plunger cap 122 has been removed from the plunger 118, which would indicate that the user, or a person helping the user, has accessed the ingestible from the container loop 102. A sensor may be implemented in the plunger cap 122 and/or integrated in the plunger 118 to provide sensor data to the alert controller, indicating whether the plunger cap has been removed from the plunger providing access to the ingestible for the user.

Figure 5:
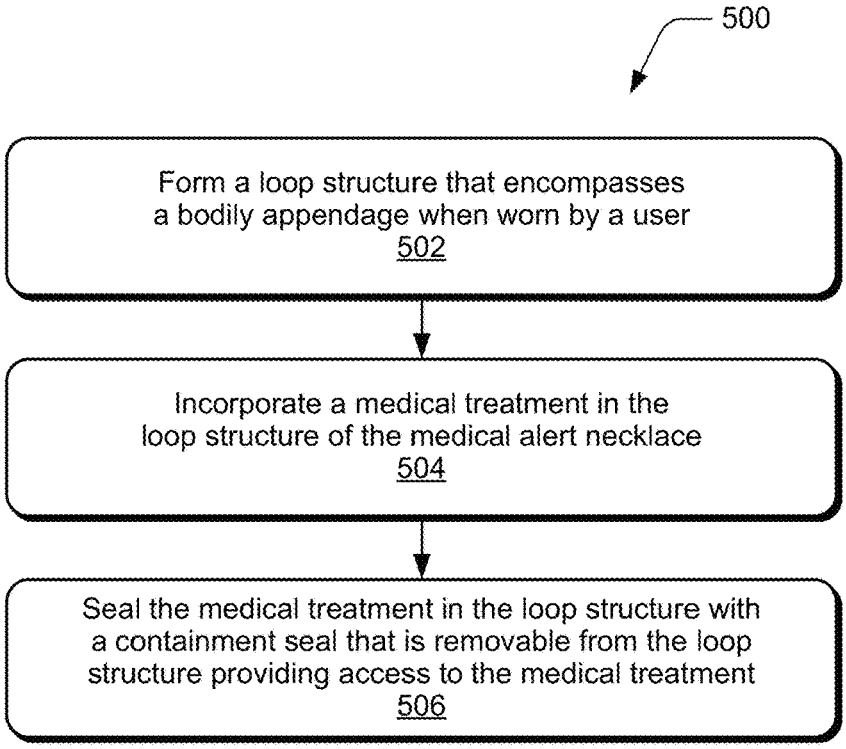
FIGS. 5-7 illustrate example methods of a medical alert necklace in accordance with one or more embodiments.

FIG. 5 illustrates an example method 500 of implementing a medical alert necklace. The order in which the method is described is not intended to be construed as a limitation, and any number or combination of the method operations can be performed in any order to implement a method, or an alternate method.

At 502, a loop structure is formed that encompasses an appendage when worn by a user. For example, the medical alert necklace 100 is an apparel item formed with the container loop 102, which is a loop structure designed to encompass an appendage when worn by a user as a necklace, bracelet, or anklet. Further, the medical alert necklace 100 has a fastening system 112 to secure the container loop 102 as worn around the neck of the user, such as with a magnetic clasp 114 or other type of quick release. The container loop 102 is formed with a void space in which a medical dose can be contained as the ingestible 104 for the user who wears the medical alert necklace.

At 504, the medical treatment is incorporated in the loop structure of the medical alert necklace. For example, the medical alert necklace 100 contains a glucose dose as a medical treatment, which can provide a diabetic person with quick access to necessary glucose, and the medical alert necklace serves as a medical and/or diabetic alert for anyone assisting an individual who may not be able to help themselves.

At 506, the medical treatment is sealed in the loop structure with a containment seal that is removable from the loop structure providing access to the medical treatment. For example, the fastening system 112 of the medical alert necklace 100 includes the plunger 118 that is press-fit into an end of the container loop 102, and the plunger cap 122 secures to the plunger 118 to seal the ingestible 104 in the container loop. Further, the plunger 118 includes the void 120 through which the ingestible 104 is distributable from the container loop 102 for consumption by the user through the plunger. Alternatively or in addition, the glucose does as the medical treatment can be sealed in the void space of the container loop 102 with a breakable seal that breaks for access to the ingestible by the user.

Figure 6:
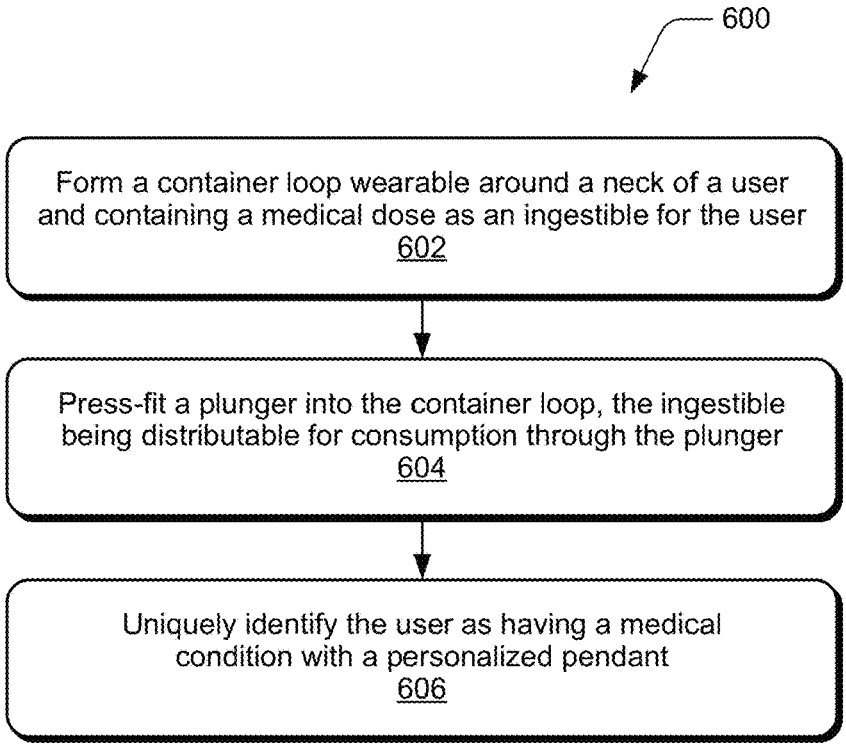

FIG. 6 illustrates an example method 600 of implementing a medical alert necklace. The order in which the method is described is not intended to be construed as a limitation, and any number or combination of the method operations can be performed in any order to implement a method, or an alternate method.

At 602, a container loop wearable around a neck of a user is formed, and the container loop contains a medical dose as an ingestible for the user. For example, the medical alert necklace 100 is formed with the container loop 102, which contains a medical dose as an ingestible 104 for the user. The container loop 102 forms a void space in which a glucose dose is contained as the ingestible 104 and is accessible to the user. The medical alert necklace 100 has a fastening system 112 to secure the container loop 102 as worn around the neck of the user, such as with a magnetic clasp 114 or other type of quick release.

At 604, a plunger is press-fit into the container loop, the ingestible being distributable for consumption through the plunger. For example, the fastening system 112 of the medical alert necklace 100 includes the plunger 118 that is press-fit into an end of the container loop 102, and the plunger 118 includes a void 120 through which the ingestible 104 is distributable for consumption by the user. The fastening system 112 also includes the plunger cap 122 that secures to the plunger 118, and the plunger cap seals the ingestible 104 in the container loop. The fastening system 112 can also include the similar-type plunger 124 that is press-fit into the other end of the container loop 102, and the plunger 124 seals the ingestible 104 in the container loop without a void through the plunger.

Alternatively, both ends of the container loop 102 may be implemented with the type of plunger 118 that includes the void 120 through which the ingestible 104 is distributable from either end of the container loop 102 for consumption by the user. In implementations, the container loop 102 is also refillable with the ingestible 104 through the void 120 in the plunger 118. For example, the plunger cap 122 is replaceable by a fill cap 302, which allows affixing a replenish device 304 that can be utilized to refill the container loop 102 with the ingestible.

At 606, the user is uniquely identified as having a medical condition with a personalized pendant. For example, the medical alert necklace 100 includes the personalized pendant 106 that uniquely identifies the user (e.g., the wearer of the medical alert necklace) as having a medical condition, such as a diabetic condition. The personalized pendant 106 can include any type of insignia 108 to identify the person as having a medical condition. Additionally, the personalized pendant 106 of the medical alert necklace 100 can include a quick response (QR) code 110, which is unique to the user and is accessible by anyone with a smartphone to identify an emergency contact person for the user and/or medical information about the user.

Example method 700 is described with reference to FIG. 7 in accordance with implementations of a medical alert necklace. Generally, any services, components, modules, methods, and/or operations described herein can be implemented using software, firmware, hardware (e.g., fixed logic circuitry), manual processing, or any combination thereof. Some operations of the example methods may be described in the general context of executable instructions stored on computer-readable storage memory that is local and/or remote to a computer processing system, and implementations can include software applications, programs, functions, and the like. Alternatively or in addition, any of the functionality described herein can be performed, at least in part, by one or more hardware logic components, such as, and without limitation, Field-programmable Gate Arrays (FPGAs), Application-specific Integrated Circuits (ASICs), Application-specific Standard Products (ASSPs), System-on-a-chip systems (SoCs), Complex Programmable Logic Devices (CPLDs), and the like.

Figure 7:
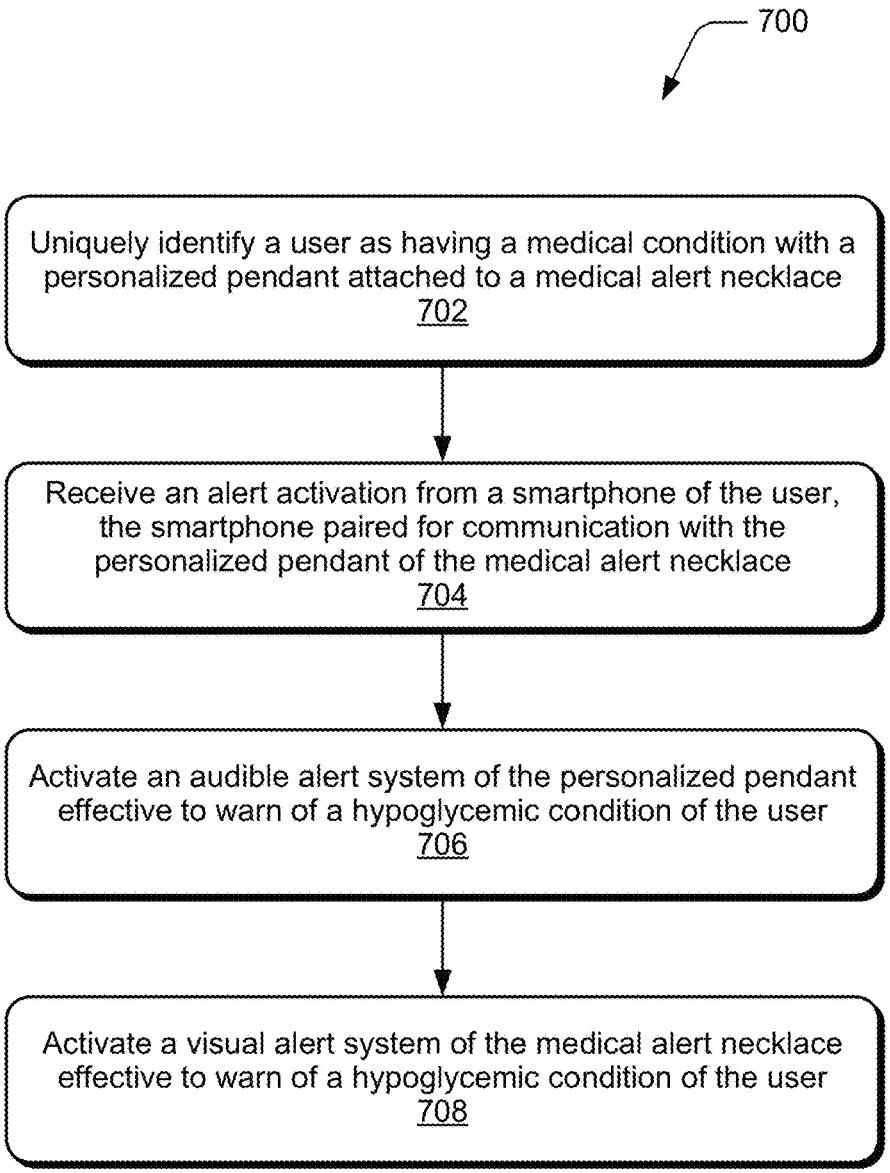

FIG. 7 illustrates an example method 700 of a medical alert necklace, and is generally described with reference to one or more alert systems of the medical alert necklace. The order in which the method is described is not intended to be construed as a limitation, and any number or combination of the method operations can be performed in any order to implement a method, or an alternate method.

At 702, a user is uniquely identified as having a medical condition with a personalized pendant attached to a medical alert necklace. For example, the medical alert necklace 100 includes the personalized pendant 106 that uniquely identifies the user (e.g., the wearer of the medical alert necklace) as having a medical condition, such as a diabetic condition. The personalized pendant 106 can include any type of insignia 108 to identify the person as having a medical condition. Additionally, the personalized pendant 106 of the medical alert necklace 100 can include a quick response (QR) code 110, which is unique to the user and is accessible by anyone with a smartphone to identify an emergency contact person for the user and/or medical information about the user.

At 704, an alert activation is received from a smartphone of the user, the smartphone paired for communication with the personalized pendant of the medical alert necklace. For example, the personalized pendant 106 of the medical alert necklace 100 receives the alert activation 438 communicated from the mobile device 402. The alert controller 430 of the alert system 424 implemented by the personalized pendant 106 then initiates an alert notice 440 based on the received alert activation. The alert controller 430 initiates the alert notice 440 to activate either one or both of the audible alert system 432 and the visual alert system 434 to warn of a pending or current hypoglycemic condition of the user.

The mobile device 402 (e.g., a smartphone) is paired for data communication with the glucose monitoring sensor 428 worn by the user who also wears the medical alert necklace 100. The mobile device 402 receives the sensor data 436 as blood sugar readings from the glucose monitoring sensor 428 worn by the user to monitor his or her blood sugar readings. The glucose monitor 414 implemented by the mobile device 402 monitors and evaluates the sensor data 436 received from the glucose monitoring sensor 428. When the glucose monitor 414 detects, or begins to detect, a drop in the user's blood sugar, the glucose monitoring application can generate and initiate to communicate an alert activation 438 to the personalized pendant 106.

At 706, an audible alert system of the personalized pendant is activated effective to warn of a hypoglycemic condition of the user. For example, the audible alert system 432 of the personalized pendant 106 is activated as a sound-emitting speaker effective to warn of a hypoglycemic condition of the user. The user and/or another person in the vicinity of the user will be alerted of the medical condition of the user based on the audible alert.

At 708, a visual alert system of the medical alert necklace is activated effective to warn of a hypoglycemic condition of the user. For example, the alert controller 430 activates the visual alert system 434, which can include LED or similar lighting of the container loop 102 emitting a flashing, pulsing, or constant light 442 effective to warn of the pending or current hypoglycemic condition of the user. The user and/or another person in the vicinity of the user will be alerted of the medical condition of the user based on the flashing, pulsing, or constant light alert.

Figure 8:
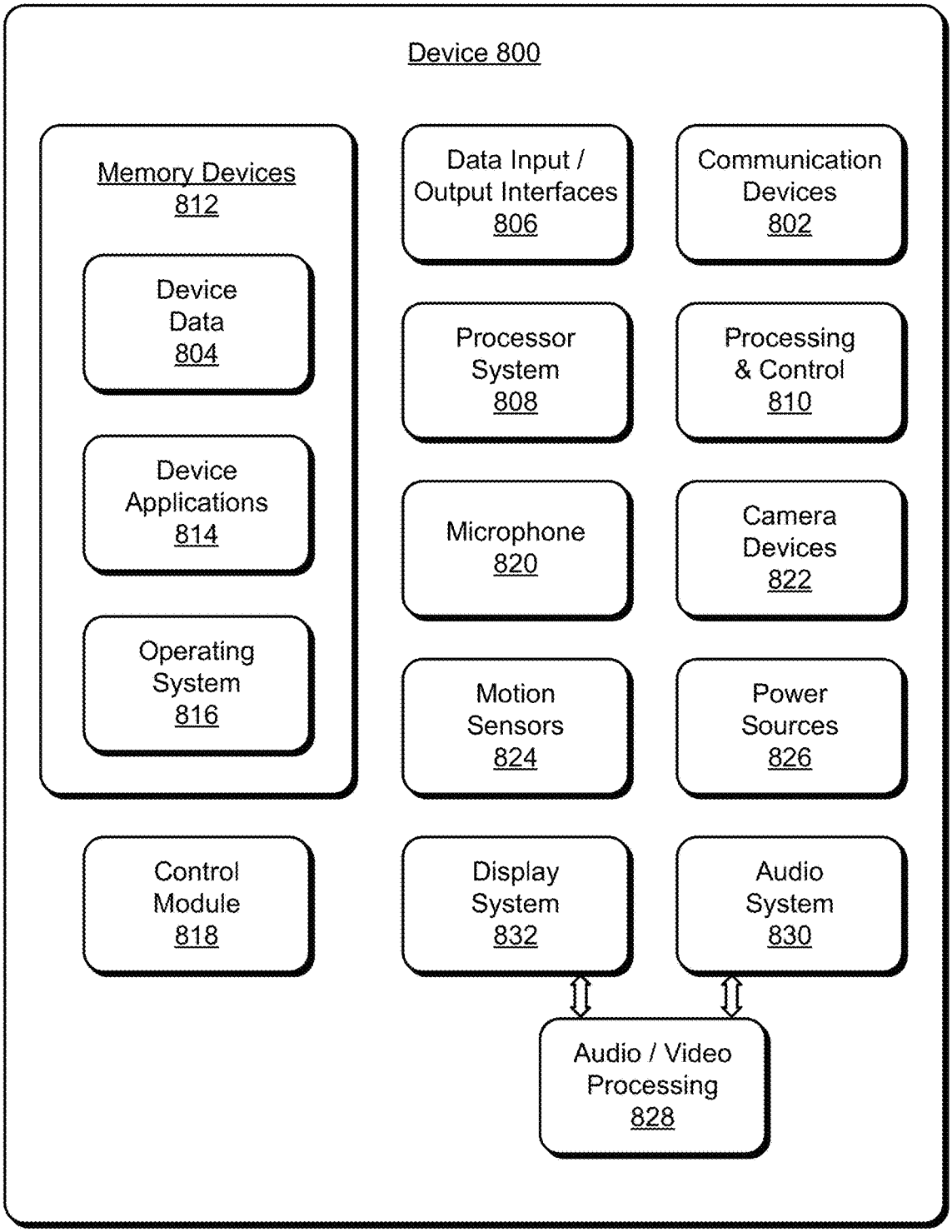
FIG. 8 illustrates various components of an example device that can be used to implement the techniques of a medical alert necklace as described herein.

FIG. 8 illustrates various components of an example device 800, which can implement aspects of the techniques and features of a medical alert necklace, as described herein. The example device 800 can be implemented as any of the devices described with reference to the previous FIGS. 1-5, such as any type of a wireless device, mobile device, mobile phone, paired device, tablet, computing, communication, and/or any other type of computing and/or electronic device. For example, the personalized pendant 106 and/or the mobile device 402 described with reference to FIGS. 1-7 may be implemented as the example device 800.

The example device 800 can include various, different communication devices 802 that enable wired and/or wireless communication of device data 804 with other devices. The device data 804 can include any of the various devices data and content that is generated, processed, determined, received, stored, and/or communicated from one computing device to another. Generally, the device data 804 can include any form of audio, video, image, graphics, and/or electronic data that is generated by applications executing on a device. The communication devices 802 can also include transceivers for cellular phone communication and/or for any type of network data communication.

The example device 800 can also include various, different types of data input/output (I/O) interfaces 806, such as data network interfaces that provide connection and/or communication links between the devices, data networks, and other devices. The I/O interfaces 806 can be used to couple the device to any type of components, peripherals, and/or accessory devices, such as a computer input device that may be integrated with the example device 800. The I/O interfaces 806 may also include data input ports via which any type of data, information, media content, communications, messages, and/or inputs can be received, such as user inputs to the device, as well as any type of audio, video, image, graphics, and/or electronic data received from any content and/or data source.

The example device 800 includes a processor system 808 of one or more processors (e.g., any of microprocessors, controllers, and the like) and/or a processor and memory system implemented as a system-on-chip (SoC) that processes computer-executable instructions. The processor system 808 may be implemented at least partially in computer hardware, which can include components of an integrated circuit or on-chip system, an application-specific integrated circuit (ASIC), a field-programmable gate array (FPGA), a complex programmable logic device (CPLD), and other implementations in silicon and/or other hardware. Alternatively or in addition, the device can be implemented with any one or combination of software, hardware, firmware, or fixed logic circuitry that may be implemented in connection with processing and control circuits, which are generally identified at 810. The example device 800 may also include any type of a system bus or other data and command transfer system that couples the various components within the device. A system bus can include any one or combination of different bus structures and architectures, as well as control and data lines.

The example device 800 also includes memory and/or memory devices 812 (e.g., computer-readable storage memory) that enable data storage, such as data storage devices implemented in hardware that can be accessed by a computing device, and that provide persistent storage of data and executable instructions (e.g., software applications, programs, functions, and the like). Examples of the memory devices 812 include volatile memory and non-volatile memory, fixed and removable media devices, and any suitable memory device or electronic data storage that maintains data for computing device access. The memory devices 812 can include various implementations of random-access memory (RAM), read-only memory (ROM), flash memory, and other types of storage media in various memory device configurations. The example device 800 may also include a mass storage media device.

The memory devices 812 (e.g., as computer-readable storage memory) provide data storage mechanisms, such as to store the device data 804, other types of information and/or electronic data, and various device applications 814 (e.g., software applications and/or modules). For example, an operating system 816 can be maintained as software instructions with a memory device 812 and executed by the processor system 808 as a software application. The device applications 814 may also include a device manager, such as any form of a control application, software application, signal-processing and control module, code that is specific to a particular device, a hardware abstraction layer for a particular device, and so on.

In this example, the device 800 includes a control module 818 that implements various aspects of the described features and techniques of a medical alert necklace, such as when implemented as the alert controller 430 in the alert system 424 of the personalized pendant 106 of the medical alert necklace. The control module 818 can be implemented with hardware components and/or in software as one of the device applications 814, such as when the example device 800 is implemented as the mobile device 402 and/or as the alert system 424 of the personalized pendant 106, as described with reference to FIGS. 1-7. In implementations, the control module 818 may include independent processing, memory, and logic components as a computing and/or electronic device integrated with the example device 800.

The example device 800 can also include a microphone 820 and/or camera devices 822, as well as motion sensors 824, such as may be implemented as components of an inertial measurement unit (IMU). The motion sensors 824 can be implemented with various sensors, such as a gyroscope, an accelerometer, and/or other types of motion sensors to sense motion of the device. The motion sensors 824 can generate sensor data vectors having three-dimensional parameters (e.g., rotational vectors in x, y, and z-axis coordinates) indicating location, position, acceleration, rotational speed, and/or orientation of the device. The example device 800 can also include one or more power sources 826, such as when the device is implemented as a wireless device and/or mobile device. The power sources may include a charging and/or power system, and can be implemented as a flexible strip battery, a rechargeable battery, a charged super-capacitor, and/or any other type of active or passive power source.

The example device 800 can also include an audio and/or video processing system 828 that generates audio data for an audio system 830 and/or generates display data for a display system 832. The audio system and/or the display system may include any types of devices or modules that generate, process, display, and/or otherwise render audio, video, display, and/or image data. Display data and audio signals can be communicated to an audio component and/or to a display component via any type of audio and/or video connection or data link. In implementations, the audio system and/or the display system are integrated components of the example device 800. Alternatively, the audio system and/or the display system are external, peripheral components to the example device.

Although implementations of a medical alert necklace have been described in language specific to features and/or methods, the appended claims are not necessarily limited to the specific features or methods described. Rather, the specific features and methods are disclosed as example implementations of a medical alert necklace, and other equivalent features and methods are intended to be within the scope of the appended claims. Further, various different examples are described and it is to be appreciated that each described example can be implemented independently or in connection with one or more other described examples. Additional aspects of the techniques, features, and/or methods discussed herein relate to one or more of the following:

A medical alert necklace, comprising: a container loop wearable around a neck of a user and configured to contain a medical dose as an ingestible for the user; a personalized pendant to uniquely identify the user as having a medical condition; and a fastening system to secure the container loop around the neck of the user, the fastening system including a plunger press-fit into the container loop, the ingestible being distributable for consumption through the plunger, and the container loop being refillable through the plunger.

Alternatively or in addition to the above described medical alert necklace, any one or combination of: the container loop forms a void space in which a glucose dose is contained as the ingestible and is accessible to the user. The personalized pendant includes a quick response (QR) code accessible to identify at least one of an emergency contact person for the user or medical information about the user. The personalized pendant includes an audible alert system, the personalized pendant configured to receive an alert activation from a smartphone and activate the audible alert system effective to warn of a hypoglycemic condition of the user. A visual alert system is configured to receive an alert activation from a smartphone and activate the visual alert system effective to warn of a hypoglycemic condition of the user. The fastening system is quick release and configured to secure the medical alert necklace as worn around a neck of the user. The fastening system includes a plunger cap secured to the plunger, the plunger cap configured to seal the ingestible in the container loop. The plunger cap is replaceable by a fill cap configured to affix a replenish device that refills the container loop with the ingestible. The fastening system includes: a magnetic clasp configured to secure the medical alert necklace as worn by the user, the magnetic clasp having a first tensional resistance that resists pulling forces separating the magnetic clasp; a plunger cap secured to the plunger, the plunger cap having a second tensional resistance that resists the pulling forces separating the plunger cap from the plunger; and the first tensional resistance is less than the second tensional resistance effective to separate the magnetic clasp before the plunger cap is separated from the plunger responsive to the pulling forces.

A medical alert necklace, comprising: a container loop wearable around a neck of a user and configured to contain a medical dose as an ingestible for the user; a fastening system configured as a magnetic clasp to secure the container loop around the neck of the user, the magnetic clasp having a first tensional resistance that resists pulling forces separating the magnetic clasp; a plunger press-fit into the container loop and a plunger cap secured to the plunger to seal the ingestible in the container loop, the plunger cap having a second tensional resistance that resists the pulling forces separating the plunger cap from the plunger, the first tensional resistance being less than the second tensional resistance effective to separate the magnetic clasp before the plunger cap is separated from the plunger responsive to the pulling forces.

Alternatively or in addition to the above described medical alert necklace, any one or combination of: the container loop forms a void space in which a glucose dose is contained as the ingestible and is accessible to the user. A personalized pendant to uniquely identify the user as having a medical condition, the personalized pendant including a quick response (QR) code accessible to identify at least one of an emergency contact person for the user or medical information about the user. The personalized pendant uniquely identifies the user and includes an alert system, the personalized pendant configured to receive an alert activation from a smartphone and activate the alert system effective to warn of a hypoglycemic condition of the user. An alert system configured to receive an alert activation from a smartphone and activate the alert system effective to warn of a hypoglycemic condition of the user. The ingestible is distributable for consumption by the user through a void in the plunger, and the container loop is refillable through the void in the plunger. The plunger cap is replaceable by a fill cap configured to affix a replenish device that refills the container loop with the ingestible.

A medical alert necklace, comprising: a container loop wearable around a neck of a user and configured to contain a medical dose as an ingestible for the user, the container loop forming a void space in which the ingestible is contained and accessible to the user; a fastening system to secure the container loop around the neck of the user, the fastening system including a plunger press-fit into the container loop, the ingestible being distributable for consumption through the plunger; a personalized pendant to uniquely identify the user as having a medical condition, the personalized pendant including a quick response (QR) code accessible to identify an emergency contact person for the user and medical information about the user; and an alert system configured to receive an alert activation from a smartphone and activate the alert system effective to warn of a hypoglycemic condition of the user.

Alternatively or in addition to the above described medical alert necklace, any one or combination of: the medical dose is a glucose dose contained as the ingestible in the void space of the container loop. The fastening system includes: a magnetic clasp configured to secure the medical alert necklace as worn by the user, the magnetic clasp having a first tensional resistance that resists pulling forces separating the magnetic clasp; a plunger cap secured to the plunger, the plunger cap having a second tensional resistance that resists the pulling forces separating the plunger cap from the plunger; and the first tensional resistance is less than the second tensional resistance effective to separate the magnetic clasp before the plunger cap is separated from the plunger responsive to the pulling forces. The plunger cap is replaceable by a fill cap configured to affix a replenish device that refills the container loop with the ingestible.

The invention claimed is:

1. A medical alert necklace, comprising:

a container loop wearable around a neck of a user and configured to contain a medical dose as an ingestible for the user;

a personalized pendant to uniquely identify the user as having a medical condition, the personalized pendant including an alert system configured to receive an alert activation from a smartphone and activate the alert system effective to warn of a hypoglycemic condition of the user;

a fastening system to secure the container loop around the neck of the user, the fastening system including:

a magnetic clasp to secure the medical alert necklace as worn by the user, the magnetic clasp having a first tensional resistance that resists pulling forces separating the magnetic clasp; and a plunger press-fit into the container loop and a plunger cap secured to the plunger, the plunger cap having a second tensional resistance that resists the pulling forces separating the plunger cap from the plunger, the first tensional resistance being less than the second tensional resistance effective to separate the magnetic clasp before the plunger cap is separated from the plunger responsive to the pulling forces, the ingestible being distributable for consumption through the plunger, and the container loop being refillable through the plunger.

2. The medical alert necklace of claim 1, wherein the container loop forms a void space in which a glucose dose is contained as the ingestible and is accessible to the user.

3. The medical alert necklace of claim 1, wherein the personalized pendant includes a quick response (QR) code accessible to identify at least one of an emergency contact person for the user or medical information about the user.

4. The medical alert necklace of claim 1, wherein the alert system is an audible alert system configured to receive the alert activation from the smartphone and activate the audible alert system effective to warn of the hypoglycemic condition of the user.

5. The medical alert necklace of claim 1, wherein the alert system is a visual alert system configured to receive the alert activation from the smartphone and activate the visual alert system effective to warn of the hypoglycemic condition of the user.

6. The medical alert necklace of claim 1, wherein the fastening system is quick release and configured to secure the medical alert necklace as worn around the neck of the user.

7. The medical alert necklace of claim 1, wherein the plunger cap is configured to seal the ingestible in the container loop.

8. The medical alert necklace of claim 7, wherein the plunger cap is replaceable by a fill cap configured to affix a replenish device that refills the container loop with the ingestible.

9. A medical alert necklace, comprising:

a container loop wearable around a neck of a user and configured to contain a medical dose as an ingestible for the user;

a fastening system configured as a magnetic clasp to secure the container loop around the neck of the user, the magnetic clasp having a first tensional resistance that resists pulling forces separating the magnetic clasp;

a plunger press-fit into the container loop and a plunger cap secured to the plunger to seal the ingestible in the container loop, the plunger cap having a second tensional resistance that resists the pulling forces separating the plunger cap from the plunger, the first tensional resistance being less than the second tensional resistance effective to separate the magnetic clasp before the plunger cap is separated from the plunger responsive to the pulling forces.

10. The medical alert necklace of claim 9, wherein the container loop forms a void space in which a glucose dose is contained as the ingestible and is accessible to the user.

11. The medical alert necklace of claim 9, further comprising a personalized pendant to uniquely identify the user as having a medical condition, the personalized pendant including a quick response (QR) code accessible to identify at least one of an emergency contact person for the user or medical information about the user.

12. The medical alert necklace of claim 9, further comprising a personalized pendant that uniquely identifies the user and includes an alert system, the personalized pendant configured to receive an alert activation from a smartphone and activate the alert system effective to warn of a hypoglycemic condition of the user.

13. The medical alert necklace of claim 9, further comprising an alert system configured to receive an alert activation from a smartphone and activate the alert system effective to warn of a hypoglycemic condition of the user.

14. The medical alert necklace of claim 9, wherein the ingestible is distributable for consumption by the user through a void in the plunger, and the container loop is refillable through the void in the plunger.

15. The medical alert necklace of claim 9, wherein the plunger cap is replaceable by a fill cap configured to affix a replenish device that refills the container loop with the ingestible.

16. A medical alert necklace, comprising:

a container loop wearable around a neck of a user and configured to contain a medical dose as an ingestible for the user, the container loop forming a void space in which the ingestible is contained and accessible to the user;

a fastening system to secure the container loop around the neck of the user, the fastening system including a magnetic clasp to secure the medical alert necklace as worn by the user, the magnetic clasp having a first tensional resistance that resists pulling forces separating the magnetic clasp, and the fastening system including a plunger press-fit into the container loop and a plunger cap secured to the plunger, the plunger cap having a second tensional resistance that resists the pulling forces separating the plunger cap from the plunger, the first tensional resistance being less than the second tensional resistance effective to separate the magnetic clasp before the plunger cap is separated from the plunger responsive to the pulling forces, the ingestible being distributable for consumption through the plunger; and a personalized pendant to uniquely identify the user as having a medical condition, the personalized pendant including a quick response (QR) code accessible to identify an emergency contact person for the user and medical information about the user.

17. The medical alert necklace of claim 16, wherein the medical dose is a glucose dose contained as the ingestible in the void space of the container loop.

18. The medical alert necklace of claim 16, wherein the plunger cap is replaceable by a fill cap configured to affix a replenish device that refills the container loop with the ingestible.

19. The medical alert necklace of claim 16, further comprising an alert system configured to receive an alert activation from a smartphone and activate the alert system effective to warn of a hypoglycemic condition of the user.

* * * * *